United States Patent [19]

Terlecky et al.

[11] Patent Number: 4,848,611

[45] Date of Patent: Jul. 18, 1989

[54] RAILROAD CAR COUPLER ARRANGEMENT LIMITING EXCESS LATERAL MOVEMENT OF THE COUPLER SHANK

[75] Inventors: Boris S. Terlecky, Woodridge; Ronald P. Sellberg, Naperville, both of Ill.

[73] Assignees: Trailer Train Company; Amsted Industries, Inc., both of Chicago, Ill.

[21] Appl. No.: 173,232

[22] Filed: Mar. 24, 1988

Related U.S. Application Data

[63] Continuation of Ser. No. 699,817, Feb. 8, 1985, Pat. No. 4,776,474.

[51] Int. Cl.[4] ..... B61G 9/04

[52] U.S. Cl. ..... 213/64; 213/50

[58] Field of Search ..... 213/50, 56, 64, 67 R, 213/69, 62 R

[56] References Cited

U.S. PATENT DOCUMENTS 1,152,041 8/1915 O'Connor ..... 213/67 R X
1,684,209 9/1928 Whitridge et al. ..... 213/69
2,019,311 10/1935 Kinne ..... 213/67 R X
4,776,474 10/1988 Terlecky et al. ..... 213/64

FOREIGN PATENT DOCUMENTS 66643 5/1969 German Democratic Rep. ... 213/64

*Primary Examiner*—James B. Marbert
*Assistant Examiner*—Gary C. Hoge
*Attorney, Agent, or Firm*—Kinzer, Plyer, Dorn, McEachran & Jambor

[57] ABSTRACT

A railroad car coupler arrangement which limits the lateral movement of square butt couplers to prevent excess longitudinal misalignment, particularly on railroad cars having single axle trucks. The coupler includes a head and shank which fit into a coupler pocket. An end wall of the shank engages a follower plate which is in contact with a draft gear cushioning device. The shank end wall has a vertically-extending recess and the follower plate has a cooperating, vertically-extending projection which interfits with the recess to limit lateral movement of the coupler shank relative to the coupler pocket transversely of the longitudinal centerline of the car.

6 Claims, 1 Drawing Sheet

C-L
11
13
15
17
19
21
23
25
27
31
33
35
37
39
40
41
43
45
47
49
53
55
57
59
63
65
67
73
75

RAILROAD CAR COUPLER ARRANGEMENT LIMITING EXCESS LATERAL MOVEMENT OF THE COUPLER SHANK

This is a continuation of co-pending application Ser. No. 699,817 filed on Feb. 8, 1985, now U.S. Pat. No. 4,776,474.

BACKGROUND OF THE INVENTION

This invention relates to railroad couplers. More particularly, it relates to what are called square butt couplers, which are usually of the so-called E type. Couplers of this type are used on cars with conventional trucks and, more recently, on cars with single axle trucks. Examples of cars with single axle trucks are found in for U.S. patent application, Ser. Nos. 409,844 filed Aug. 20, 1982; for 597,642 filed Apr. 6, 1984; for 653,821 filed Sept. 24, 1984; and for 653,831, filed Sept. 24, 1984; all of which are owned by the common assignee. The disclosure of these applications are hereby expressly incorporated by reference into this application.

In a conventional square butt coupler, the rear part of the square butt coupler shank has considerable latitude for lateral movement. On cars with single axle trucks, this can result in unfavorable coupler angles with respect to the car center line under certain train operating conditions.

SUMMARY OF THE INVENTION

The present invention encompasses a railroad car coupler arrangement which stabilizes and centers the back end of a square butt coupler. It is of particular advantage in reducing the lateral movement of the rear end of the coupler shank of a square butt coupler when it is used in a still pocket on a car with single axle trucks. The purpose of stabilizing and centering the back end of the square butt coupler is to eliminate unfavorable coupler angle with respect to the car's center line under certain operating conditions, particularly in buff loading.

DETAILED DESCRIPTION

Figures 1, 2, 3, 4:
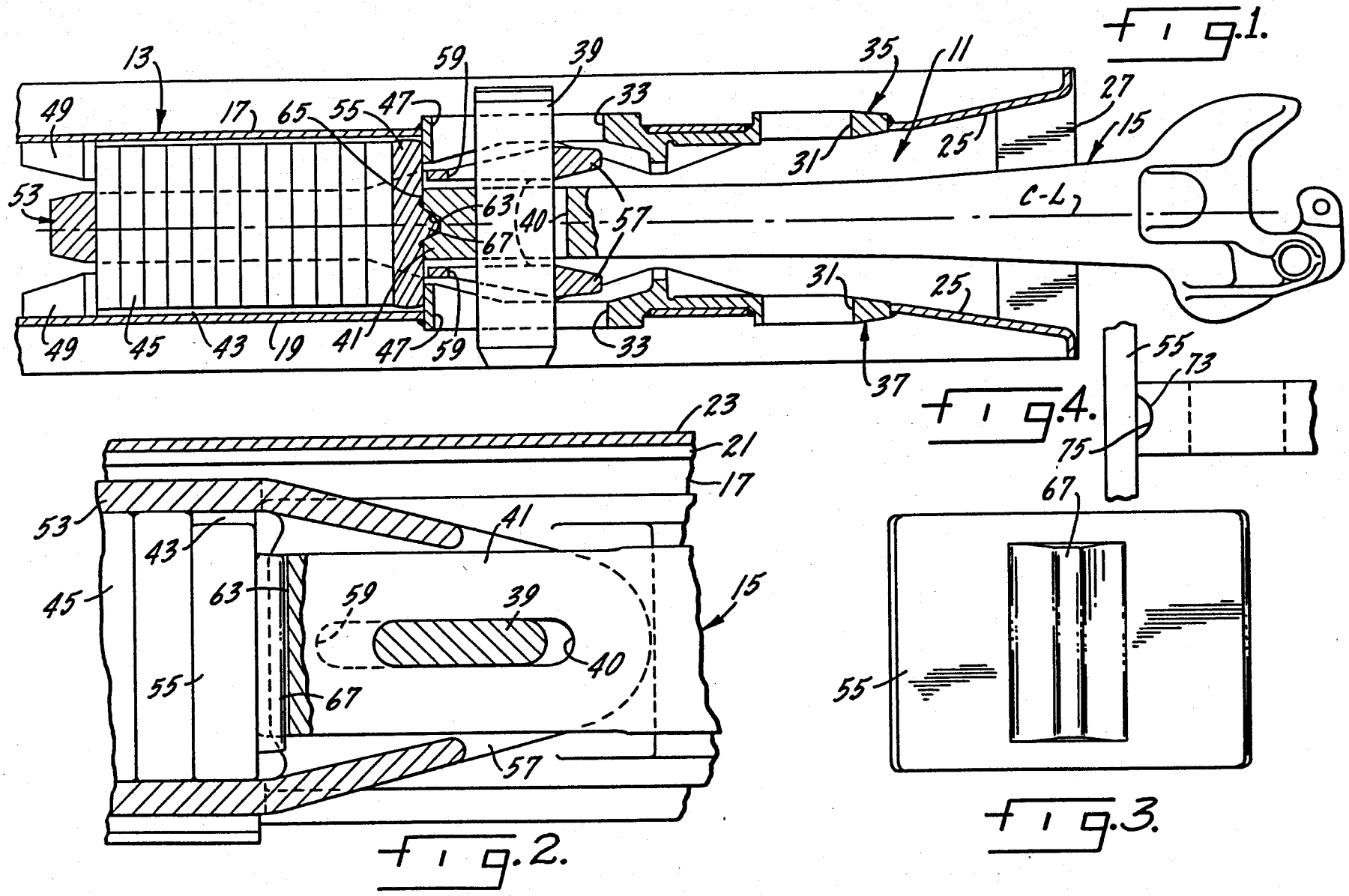
FIG. 1 is a top plan view, partially in section, showing a car coupling arrangement incorporating the features of the present invention.
FIG. 2 is an enlarged, partial, side elevational view of the car coupling arrangement of FIG. 1.
FIG. 3 is an elevational view of the follower block of this invention shown on the same scale as that of FIG. 2.
FIG. 4 is a top plan view of a portion of the apparatus of FIG. 1 showing a modified form of the invention.

Referring now to the drawings, FIG. 1 illustrates a railroad coupler pocket 11 which is formed integrally of the centersill 13 of a railroad car which, of course, is the main structural member of the car. In accordance with the advantages of the present invention, the car includes trucks with single axles, such as the car shown in United States patent applications identified above.

The coupler pocket 11 permits connection of the car using a standard car coupler such as the E-type coupler 15 and also permits the use of semi-permanent drawbar connections when multi-platform cars are connected to each other. Such a coupler pocket is described in U.S. patent application Ser. No. 597,642. The inventive concept is equally applicable to a coupler pocket connection which receives only a coupler, and not a drawbar. The advantages obtained, however, are particularly significant to cars with single axle trucks.

As is conventional, the centersill 13 includes a pair of spaced apart vertical plates 17 and 19 welded to a top plate, not shown, to form the channel beam construction of the centersill 13. An access opening 21 is formed in the top plate to provide ingress into the coupler pocket 11. A removable cover plate 23 is provided to normally close the access opening 21.

Vertical plates 17 and 19 include portions 25 adjacent the end of the sill which are each disposed at an acute angle to the longitudinal center line of the centersill 13. These portions form a wide mouth 27 which accommodates lateral pivoting of the car coupling member as the car negotiates curves.

Pairs of aligned forward draft key slots 31 and rearward draft key slots 33 are formed respectively in castings 35 and 37 which fit into openings formed in the vertical plates 17 and 19 of the centersill 13. The castings are fastened to the vertical plates by welding in the manner described in said U.S. patent application Ser. No. 597,642, filed Apr. 6, 1984. Forward draft key slots 31 are used for connection of a semi-permanent drawbar connection (not shown) while the rearward draft key slots 33 are used to connect the E-type coupler 15 as shown in FIG. 1 of the drawings of this application using a standard key 39. A standard key retainer (not shown) is used to removably retain the key 39 in position. The standard key 39 extends through a key slot 40 in the coupler shank 41.

A chamber 43 for a draft gear or cushioning device 45 is formed between the vertical plates 17 and 19 of the centersill 13, the rear stops 47 formed on the castings 35 and 37 and the draft gear stop blocks 49 formed on the vertical plates 17 and 19. The rear stops 47 on the castings and the draft gear stop blocks 49 respectively limit forward and rearward movement of the cushioning device 45.

A coupler yoke 53 encircles the cushioning device 45 and a follower plate 55 which is located at the forward end of the cushioning device. The coupler yoke has webs 57 positioned ahead of the follower plate 55 and on opposite sides of the shank 41 of the coupler 13. Key slots 59 are formed in the webs and these align with the key slots 33 in the castings 35 and 37 and the key slot 40 in the shank 41 which together receive the coupler key 39.

In accordance with the principles of this invention, in order to reduce the lateral movement of the rear end of the coupler shank 41, a vertically extending recess 63 is formed in the butt end wall 65 of the coupler shank 41. In this embodiment of the invention, the vertical extending recess 63 is shown as trapezoidal in horizontal cross-section. A somewhat complementary vertically extending projection 67 is formed on the follower plate 55 with this projection designed to mesh in the recess 63. The projection is shown as somewhat trapezoidal in horizontal cross-section and complementary in size to the recess 63 so that it will be received in the recess 63. However, its included angle is smaller than the opening angle of the recess to prevent binding. Also, the recess is deeper than the projection 67. The projection is cast as a part of the follower plate and its cross-sectional configuration is somewhat rounded from a trapezoidal shape to more readily mesh with the trapezoidal recess 63. Relief grooves are formed on opposite sides of the trapezoidal projection 67 at the base thereof. The engagement between the projection 67 of the follower plate 55 with the recess 63 in the butt end wall 65 of the shank 41 limits lateral movement of the shank but allows the shank of the coupler 15 to move vertically without binding.

It should be appreciated that any number of suitable shapes may be utilized for the recess 63 and projection 67. FIG. 4, for example, illustrates a projection 73 with a semi-circular cross-section that is received in a semi-circular recess 75. It should be noted that the recess 63 and projection 67 are formed so as to be disposed along the car centerline designated C-L in FIG. 1 when the coupler and car are in alignment. Follower plate 55 is not susceptible of movement transverse of the longitudinal centerline C-L because it is captured within chamber 43.

With the coupler of this invention, tractive effort to the E-type coupler 15 is transmitted to the car body centersill 13 through the cushioning device 45. In traction, the rearward edge of the coupler shank key slot 40 engages key 39 and pulls it into contact with the forward edges of key slots 59 of the webs 57 of the coupler yoke 53. The yoke 53 compresses the cushioning device 45 against the draft gear follower plate 55 to impart traction forces to the rear stops 47 on the castings 35 and 37. During this traction force, the projection 67 on the follower plate 55 will still be meshed in the recess 63 of the butt end wall 65 of the coupler shank 41 thereby limiting lateral movement of the coupler shank.

In buff loading, the butt end wall 65 of the coupler shank 41 engages the face of draft gear follower plate 55. The follower plate 55 urges the cushioning device 45 towards the stop blocks 49 at the rearward end of the cushioning device chamber 43 and compresses it against these stops. The blocks 49 transmit the buff loading to the centersill 13. During buff loading, the recess 63 of the coupler shank receives the projection 67 of the follower plate to limit lateral movement of the coupler shank.

It will be apparent to those skilled in the art that various additions, substitutions, modifications, and omissions may be made to the construction of the present invention without departing from the scope or spirit of the invention. Thus, it is intended that the present invention cover the addition, substitution, modification and omissions of this invention which come within the permissible scope of the appended claims.

We claim:

1. A railroad coupling arrangement including:
means defining a coupler pocket,
a coupler having a head and a shank,
the coupler shank extending into the coupler pocket and having a butt end having an end wall which is located inside the coupler pocket,
a draft gear cushioning device disposed in said pocket adjacent said butt end and compressible thereby,
said cushioning device having a follower plate defining a first wall surface that engages the butt end wall,
one of the engaging walls of the coupler shank butt end and the follower plate having a vertically extending recess and the other of the walls having a complementary, vertically extending projection which interfit to limit lateral movement of the coupler shank relative to the coupler pocket transversely of the longitudinal centerline of the car,
said follower plate having a second wall surface parallel to the first wall surface in contact with the cushioning means within said cushioning device,
said follower plate further defining spaced, parallel wall surfaces extending between said first wall surface and said second wall surface,
said spaced parallel walls extending parallel to the longitudinal extent of said vertically extending projection and being generally perpendicular to said first and second wall surfaces.

2. The railroad coupling arrangement of claim 1 in which the vertically extending projection is formed in the wall of the follower plate and the vertically extending recess is formed on the end wall of the coupler shank.

3. The railroad coupling arrangement of claim 1 in which the vertically extending recess and the complementary, vertically extending projection are each semi-circular in cross-section.

4. In a railroad car having a single axle truck, a coupling arrangement including:
means defining a coupler pocket,
a coupler having a head and a shank,
the coupler shank extending into the coupler pocket and having a butt end having an end wall which is located inside the coupler pocket,
a draft gear cushioning device disposed in said pocket adjacent said butt end and compressible thereby,
said cushioning device having a follower plate defining a first wall surface that engages the butt end wall,
said plate having a second wall surface parallel to the first wall surface in contact with cushioning means within said cushioning device,
one of the engaging walls of the coupler shank butt end and the follower plate having a vertically extending recess and the other of the walls having a complementary, vertically extending projection which interfit to limit lateral movement of the coupler shank relative to the coupler pocket transversely of the longitudinal centerline of the car,
said plate further defining spaced, parallel wall surfaces extending between said first wall surface and said second wall surface, said spaced parallel walls extending parallel to the longitudinal extent of said vertically extending projection and being perpendicular to said first wall surface and said second wall surface.

5. The coupling arrangement of claim 4 in which the vertically extending projection is formed in the wall of the follower plate and the vertically extending recess is formed on the end wall of the coupler shank.

6. The coupling arrangement of claim 4 in which the vertically extending recess and the complementary, vertically extending projection are each semi-circular in cross-section.

* * * * *